United States Patent [19]

Shen

[11] Patent Number: 4,732,023

[45] Date of Patent: Mar. 22, 1988

[54] MODIFIABLE CYLINDER

[76] Inventor: Chao C. Shen, No. 62, Ho Shan Street, Tainan, Taiwan

[21] Appl. No.: 896,803

[22] Filed: Aug. 15, 1986

[51] Int. Cl.[4] ..... E05B 25/00

[52] U.S. Cl. ..... 70/383; 70/358; 70/364 A; 70/367; 70/378

[58] Field of Search ..... 70/382–384, 70/357–359, 363, 364, 367, 376, 378

[56] References Cited

U.S. PATENT DOCUMENTS

| | | | |
|---|---|---|---|
| 2,113,007 | 4/1938 | Swanson | 70/382 X |
| 2,427,814 | 9/1947 | Schachinger | 70/383 |
| 2,427,837 | 9/1947 | Connell | 70/383 |
| 2,818,723 | 1/1958 | Levin | 70/383 |
| 3,070,987 | 1/1963 | Baker et al. | 70/383 |
| 3,090,219 | 5/1963 | Levin | 70/383 X |
| 3,175,378 | 3/1965 | Russell | 70/382 |
| 3,338,078 | 8/1967 | Eberitch et al. | 70/382 X |
| 3,599,456 | 8/1971 | Bessim | 70/383 X |
| 4,233,828 | 11/1980 | Davenbaugh | 70/383 X |
| 4,282,731 | 8/1981 | Taksony | 70/364 A |
| 4,631,941 | 12/1986 | Sjunnesson | 70/358 X |
| 4,638,651 | 1/1987 | Surko, Jr. | 70/364 A |

FOREIGN PATENT DOCUMENTS

| | | | |
|---|---|---|---|
| 0006765 | 1/1980 | European Pat. Off. | 70/383 |
| 2354976 | 5/1975 | Fed. Rep. of Germany | 70/383 |

*Primary Examiner*—Robert L. Wolfe
*Assistant Examiner*—Suzanne L. Dino
*Attorney, Agent, or Firm*—Steinberg & Raskin

[57] ABSTRACT

A modifiable cylinder which comprises a plug and a cylinder body. The plug fits into the cylinder body and has a keyway and a plurality of bottom pin holes which are disposed above and perpendicular to the keyway. Each of the bottom pin holes has a bottom pin. The cylinder body comprises a main chamber housing and a subchamber housing. The main chamber housing has a plurality of top pin holes, each of which has a spring and a top pin. In open position, the top pin holes are aligned with the bottom pin holes. The subchamber housing has a plurality of top pin holes, each of which has a spring, a top pin and several discs. When the plug is turned to the modifying position, the top pin holes are aligned with the bottom pin holes so that the discs can be moved into the bottom pin holes so as to modify the inner combination of the cylinder.

1 Claim, 12 Drawing Figures

MODIFIABLE CYLINDER

BACKGROUND OF THE INVENTION

A conventional cylinder can only be operated by a particular key. Referring to FIGS. 11 and 12, it can be seen that conventional cylinders comprise a plug (100) and a cylinder body (200) which allows the plug (100) to be placed therein. The plug (100) has a keyway (101) and a plurality of bottom pin holes (102) which are arranged above the keyway (101). Each of the bottom pin holes (102) has a bottom pin (103) and the bottom pins are of differing lengths. The cylinder body (200) has a chamber (201) which is drilled with a plurality of top pin holes (202). Each of the top pin holes (202) is aligned with the bottom pin hole (102) and has a top pin (203) and a spring (204). A key (not shown) has a plurality of cut notches. The key is inserted into the keyway (101) and its notches push the bottom pins (103) upward. If the key is a correct one, then the key may push all the bottom pins (103) to the position in which all the top ends of the bottom pins (103) are at a shear line, so that the plug (100) can be rotated relative to the cylinder body (200) by the key to open the lock. As previously mentioned, every lock can be fitted for one key combination number only. If the user of the lock changes, then the lock must be changed for the protection of the latter user. For example, if an apartment is rented first to person A, and some time later to person B, then person B can not be sure that person A did not duplicate the keys of the locks and keep the duplicated keys. Therefore, the latter renter must change all the locks or cylinders to protect his property. But it is uneconomical and inconvenient for the user to change all the locks or cylinders of the building.

SUMMARY OF THE INVENTION

It is the purpose of the present invention, therefore, to mitigate and/or obviate the above-mentioned drawbacks in the manner set forth in the detailed description of the preferred embodiment.

A primary objective of this invention is to provide a modifiable cylinder in which the combination of pin tumblers and discs of the cylinder are changed by a designated key so that the original cylinder will become useless and the key can be operated only by this designated key.

A further objective of this invention is to provide a modifiable cylinder which can be easily modified so as to adjust the length of bottom pins so that the lock can be operated by the original key and alternate keys with different key combinations. Further objectives and advantages of the present invention will become apparent as the following description proceeds, and the features of novelty which characterize the invention are pointed out with particularity in the claims annexed to and forming a part of this invention.

DETAILED DESCRIPTION OF THE PREFERRED EMBODIMENT

Figure 1:
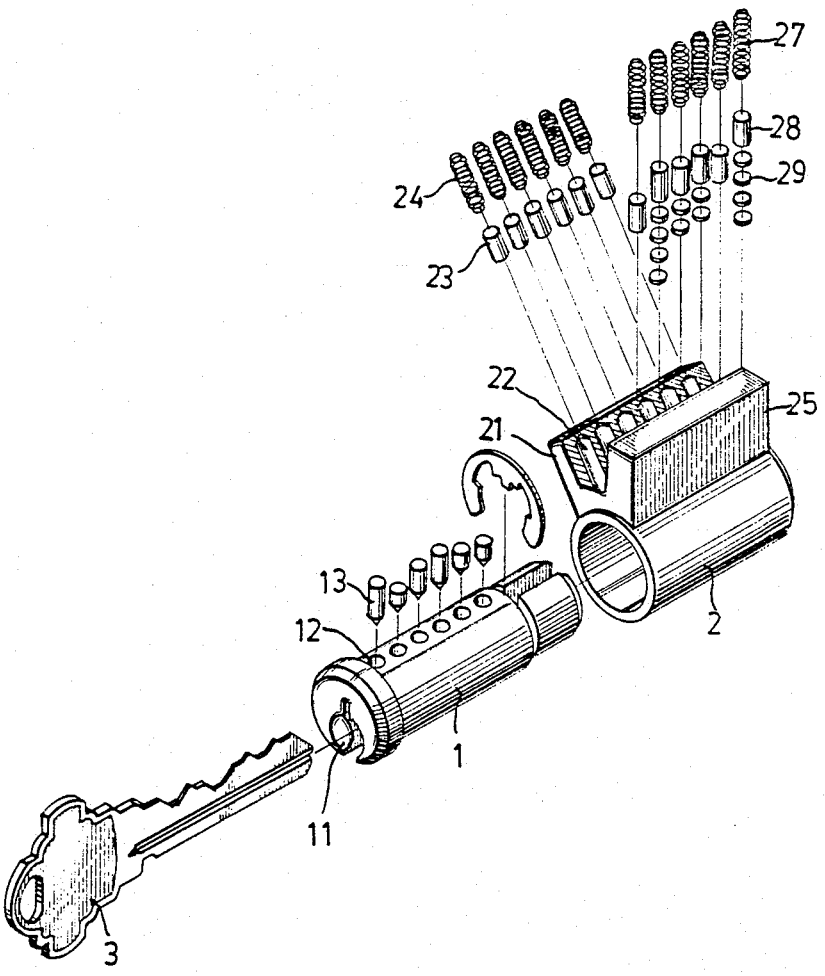
FIG. 1 is an exploded view of a modifiable cylinder according to the present invention.
Figure 2:
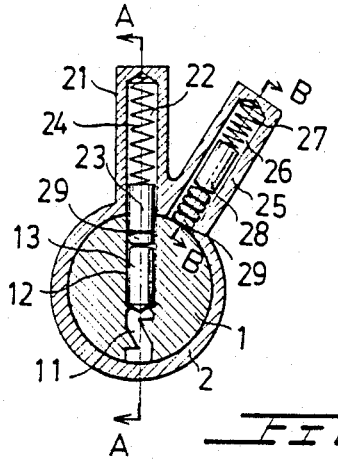
FIG. 2 is a cross-sectional view of the present invention showing the inner structure of the plug and cylinder body of the modifiable cylinder.

Referring to FIG. 1, it can be seen that the cylinder according to the present invention is similar to a conventional cylinder in that the plug (1) comprises a keyway (11) and a plurality of bottom pin holes (12), each of which has a bottom pin (13). The cylinder body (2) has a cylindrical slot which accepts the plug (1) and also comprises a main chamber housing (21) having a plurality of top pin holes (22), each of which has a top pin (23) and a spring (24). The main feature of the present invention is that the cylinder body (2) further comprises a subchamber head or housing (25) which is similar to the main chamber housing (21). The subchamber housing (25) has a plurality of storage slots (26) (referring to FIG. 2) which can be aligned with bottom pin holes (12) of the plug (1) when the plug (1) is rotated to the modifying position. Each top pin hole (26) has a spring (27), a top pin (28) and several discs (29) therein.

Figure 3:
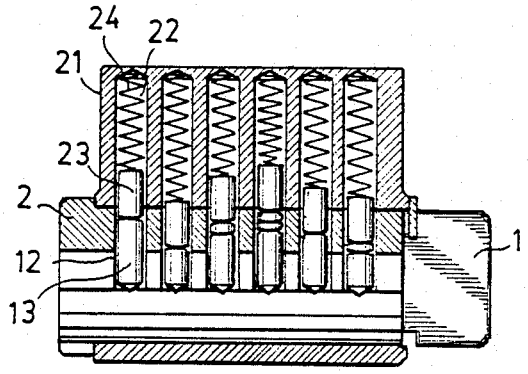
FIG. 3 is a cross-sectional view of FIG. 2 along line A—A.
Figure 4:
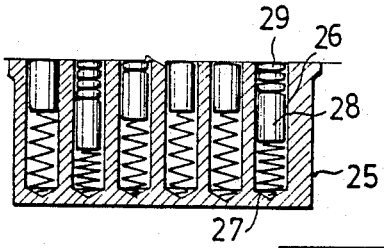
FIG. 4 is a cross-sectional view of FIG. 2 along line B—B.

Referring to FIGS. 3 and 4, it can be seen that the main chamber housing (21) has been arranged with discs (29) in the bottom pin holes (12) and the subchamber housing (25) still stores a certain amount of discs. In this condition, the cylinder's original key (3) can be used to push the bottom pins (13), together with the discs (29), upward, so that the top ends of bottom pins (13) which have no disc (29) disposed above them and the discs (29) which are disposed on the bottom pin holes (12) are at the shear line (as shown in FIG. 5) in order that the key (3) may turn the plug (1) rotating relative to the cylinder body (2) to operate the cylinder.

Figure 5:
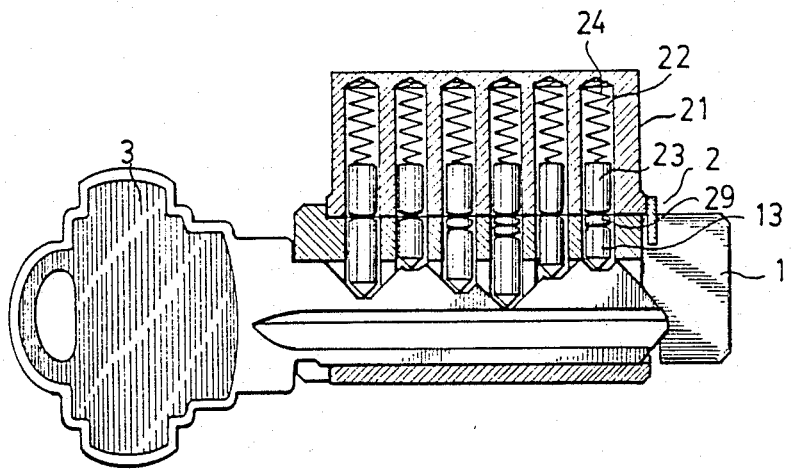
FIG. 5 shows an original key inserted in the key hole of the plug at the home position in order to operate the cylinder.
Figure 6:
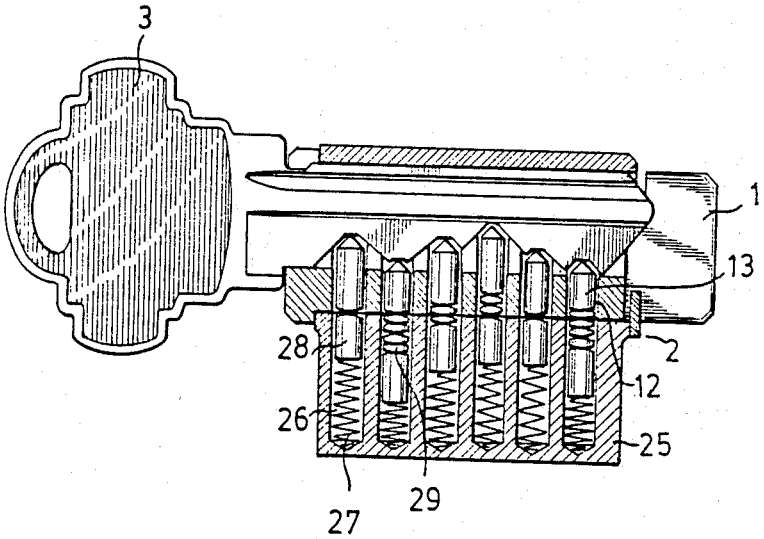
FIG. 6 is a sectional view inverted with respect to FIG. 1 and showing that the original key turns the plug to a modifying position, that is, the storage slots are aligned with the bottom pin holes respectively.
Figure 7:
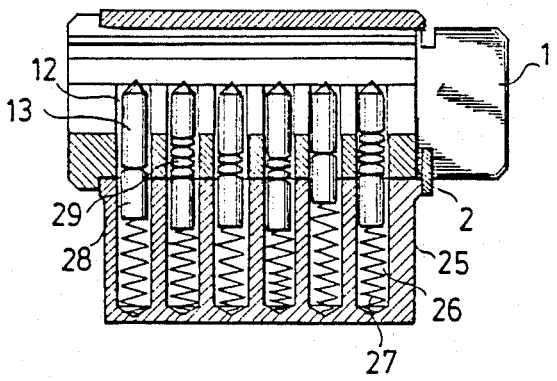
FIG. 7 shows that the original key is removed.
Figure 8:
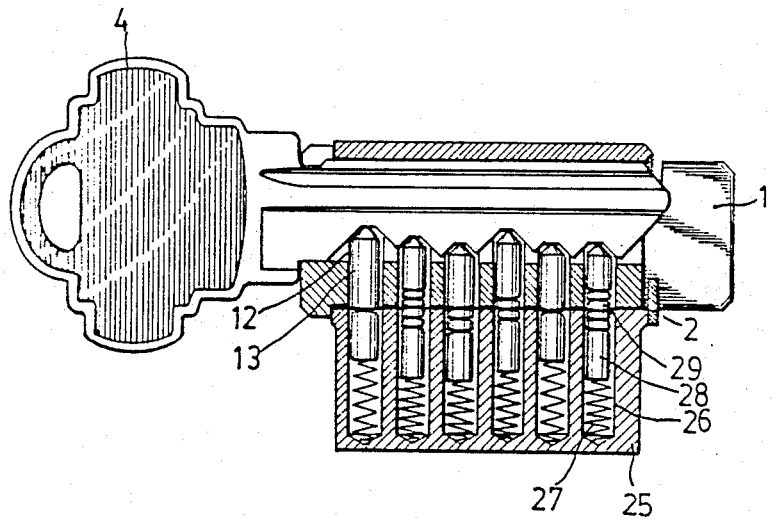
FIG. 8 shows that a designated new key is inserted into the keyway of the plug.
Figure 9:
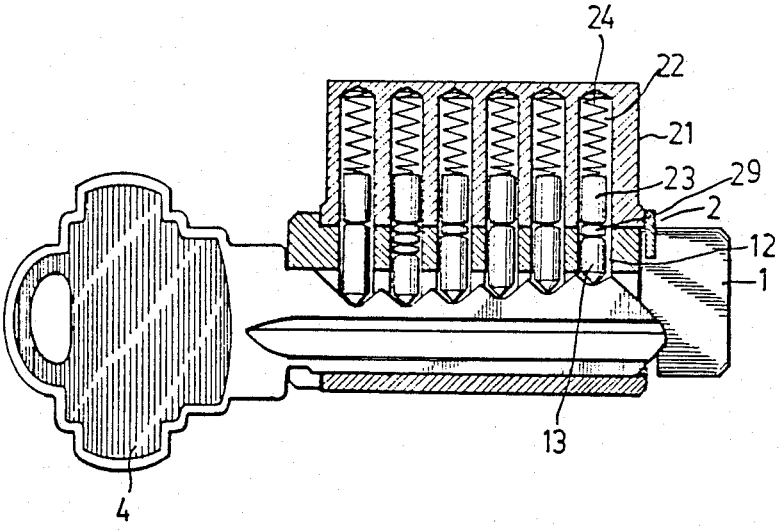
FIG. 9 shows the new key after it has turned the plug back to the home position.
Figure 10:
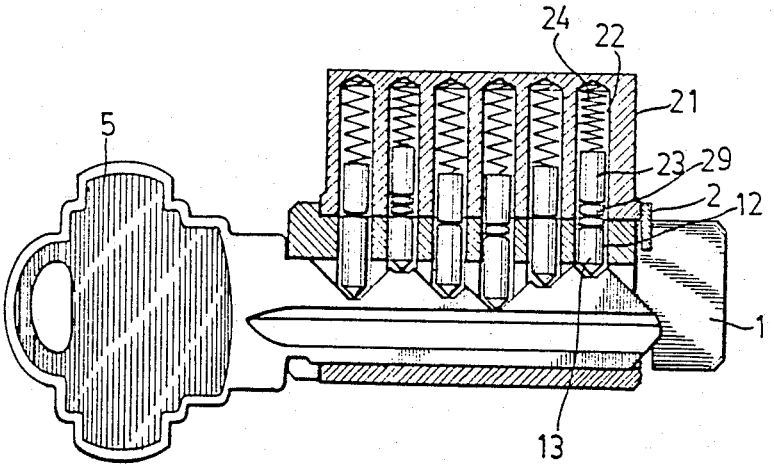
FIG. 10 shows that if the wrong key is inserted into the keyway it can not operate the cylinder.
Figure 11:
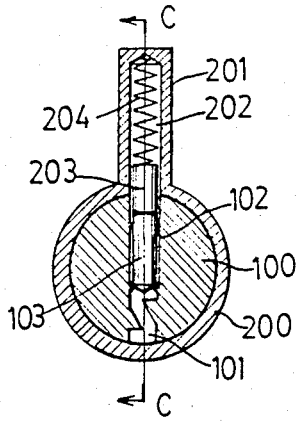
PRIOR ART FIG. 11.
FIG. 11 is a cross-sectional view of a conventional lock without the key.
Figure 12:
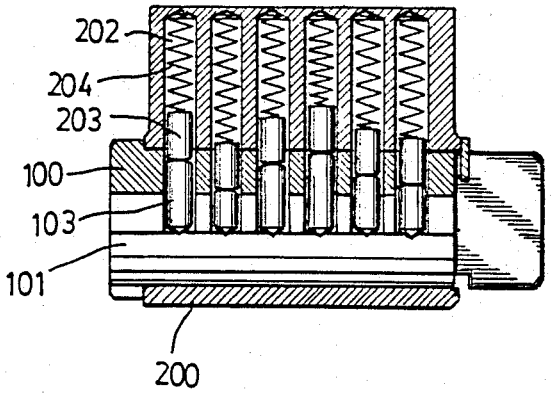
PRIOR ART FIG. 12.
FIG. 12 is a cross-sectional view of FIG. 11 along line C—C of the conventional cylinder of FIG. 11.

When the user intends to modify the tumbler combination of the cylinder, he can use the original key (3) to turn the plug (1) from home position (as shown in FIG. 5) to the modifying position. In other words, the bottom pin holes (12) are aligned with the top pin holes (26) of the subchamber housing (25) (as shown in FIG. 6). Then, when the original key (3) is removed, as shown in FIG. 7, all the discs (29) will be moved into the bottom pin holes (12) of the plug (1). And then, a designated new key (4) is inserted into the keyway (11) of the plug (1), as shown in FIG. 8. Since the new key (4) has recesses of different depths from those of the original key (3), the new key (4) accommodates a different number of spring-loaded discs (29) in the bottom pin holes (12). Finally, turning the plug (1) back to the home position (as shown in FIG. 9) will modify the combination of the cylinder, that is, the original key (3) can not operate the cylinder any more, and the cylinder can be operated only by the new key (4). Referring to FIG. 10, it can be seen that if someone uses a key (5) other than the new key, even the original key (3), he can not operate the lock.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A modifiable cylinder lock comprising a cylindrical body having an axial bore formed therein, a plug mounted in said axial bore for rotation, said plug comprising a keyway and a plurality of axially-spaced, radially-extending inner pinholes communicating with said keyway, each pinhole opening onto an outer surface of said plug, an inner pin disposed in each of said inner pinholes of said plug, an elongated main chamber housing extending substantially radially outwardly from an outer cylindrical surface of said cylindrical body, said main chamber housing having a plurality of axially-spaced, radially-extending outer pinholes which are alignable with said inner pinholes of said plug when said plug is rotated to a first position, a first outer pin situated in each of said outer pinholes and first spring means for urging said first outer pins inwardly, an elongated subchamber housing extending substantially radially outwardly from said outer cylindrical surface of said cylindrical body, said subchamber housing having a plurality of axially-spaced, radially-extending storage slots which are alignable with said inner pinholes of said plug when said plug is rotated to a second position, said main chamber housing and said subchamber housing being situated upon said outer surface of said cylindrical body to substantially form a V with one another in a radial plane of said cylindrical lock, a second outer pin and a plurality of discs situated in each of said storage slots and second spring means for urging said second outer pins and discs inwardly, such that when a designated new key is inserted into said plug keyway when said plug is at said second position, a different number of discs from each said storage slot move into said respective inner pinholes, thereby modifying a tumbler combination of the lock to match notches in the new key.

* * * * *